US011022376B2

(12) United States Patent
Takahashi et al.

(10) Patent No.: US 11,022,376 B2
(45) Date of Patent: Jun. 1, 2021

(54) HEAT EXCHANGER

(71) Applicant: Sumitomo Precision Products Co., Ltd., Amagasaki (JP)

(72) Inventors: Suguru Takahashi, Amagasaki (JP); Yasuhiro Fujita, Amagasaki (JP); Tatsuya Morikawa, Amagasaki (JP)

(73) Assignee: Sumitomo Precision Products Co., Ltd., Amagasaki (JP)

( * ) Notice: Subject to any disclaimer, the term of this patent is extended or adjusted under 35 U.S.C. 154(b) by 122 days.

(21) Appl. No.: 16/339,453

(22) PCT Filed: Oct. 7, 2016

(86) PCT No.: PCT/JP2016/079980
§ 371 (c)(1),
(2) Date: Apr. 4, 2019

(87) PCT Pub. No.: WO2018/066128
PCT Pub. Date: Apr. 12, 2018

(65) Prior Publication Data

US 2020/0049411 A1 Feb. 13, 2020

(51) Int. Cl.
*F28D 7/10* (2006.01)
*F28D 9/00* (2006.01)
(Continued)

(52) U.S. Cl.
CPC ..... *F28D 7/103* (2013.01); *F28D 7/106* (2013.01); *F28D 9/0031* (2013.01); *F28F 3/025* (2013.01);
(Continued)

(58) Field of Classification Search
CPC ..... F28D 7/103; F28D 7/106; F28D 9/0031; F28F 3/025; F28F 3/06; F28F 13/14; F28F 2265/14
See application file for complete search history.

(56) References Cited

U.S. PATENT DOCUMENTS 5,341,769 A 8/1994 Ueno et al.
9,927,184 B2 * 3/2018 Fujita ..... F28F 3/025
(Continued)

FOREIGN PATENT DOCUMENTS

DE 10 2006 017 434 A1 2/2007
EP 1 054 225 A1 11/2000
(Continued)

OTHER PUBLICATIONS

International Search Report (PCT/ISA/210) issued in PCT Application No. PCT/JP2016/079980 dated Dec. 13, 2016 with English translation (four (4) pages).
(Continued)

*Primary Examiner* — Jon T. Schermerhorn, Jr.
(74) *Attorney, Agent, or Firm* — Crowell & Moring LLP

(57) ABSTRACT

A heat exchanger includes a first flow path through which a first fluid flows, a second flow path through which a second fluid flows, and an adjustment layer disposed between the first flow path and the second flow path adjacent to each other and that adjusts an amount of heat exchange between the first flow path and the second flow path. The adjustment layer includes a first portion and a second portion having a heat transfer performance lower than that of the first portion, and has a heat transfer performance varied depending on a position in the adjustment layer.

6 Claims, 7 Drawing Sheets

(51) Int. Cl.
*F28F 3/02* (2006.01)
*F28F 3/06* (2006.01)
*F28F 13/14* (2006.01)

(52) U.S. Cl.
CPC ..... *F28F 3/06* (2013.01); *F28F 13/14* (2013.01); *F28F 2265/14* (2013.01)

(56) References Cited

U.S. PATENT DOCUMENTS

| | | | | |
|---|---|---|---|---|
| 10,465,991 | B2 * | 11/2019 | Van Bockryck | F28D 9/0062 |
| 2008/0308264 | A1 * | 12/2008 | Antonijevic | F28D 1/05375 165/165 |
| 2010/0139901 | A1 * | 6/2010 | Takada | F28F 3/025 165/166 |
| 2010/0181053 | A1 | 7/2010 | Hecht et al. | |
| 2015/0316326 | A1 | 11/2015 | Choi | |
| 2017/0108284 | A1 * | 4/2017 | Fujita | F28F 3/025 |
| 2017/0162884 | A1 * | 6/2017 | Shimada | H01M 8/0258 |
| 2018/0073811 | A1 * | 3/2018 | Taras | F28F 3/046 |
| 2019/0056164 | A1 * | 2/2019 | Yamada | F28D 15/00 |
| 2020/0064083 | A1 * | 2/2020 | Mitsuhashi | F28F 27/00 |

FOREIGN PATENT DOCUMENTS

| | | | |
|---|---|---|---|
| GB | 2531945 | A | 5/2016 |
| JP | 62-28693 | A | 2/1987 |
| JP | 5-164482 | A | 6/1993 |
| JP | 8-159683 | A | 6/1996 |
| JP | 2002-323295 | A | 11/2002 |
| JP | 2010-101617 | A | 5/2010 |
| JP | 2016-503483 | A | 2/2016 |
| WO | WO 2015/141634 | A1 | 9/2015 |

OTHER PUBLICATIONS

Japanese-language Written Opinion (PCT/ISA/237) issued in PCT Application No. PCT/JP2016/079980 dated Dec. 13, 2016 (four (4) pages).

Extended European Search Report issued in counterpart European Application No. 16918324.1 dated Sep. 17, 2019 (seven (7) pages).

* cited by examiner

SIMULATION RESULTS OF COMPARATIVE EXAMPLE 1 (NO ADJUSTMENT LAYER) (FLOW PATH LENGTH RATIO: 0.38)

SIMULATION RESULTS OF COMPARATIVE EXAMPLE 2 (HEAT TRANSFER FIN 34a OVER ENTIRE ADJUSTMENT LAYER) (FLOW PATH LENGTH RATIO: 1.18)

FIG. 14 (MODIFIED EXAMPLE: CROSSFLOW TYPE)
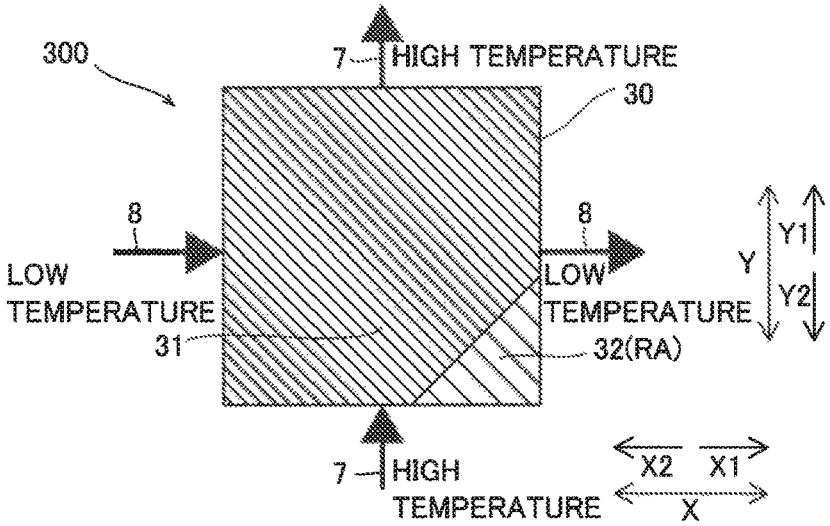
FIG. 15 (MODIFIED EXAMPLE: NO PHASE CHANGE, LOW-TEMPERATURE FIRST FLUID)
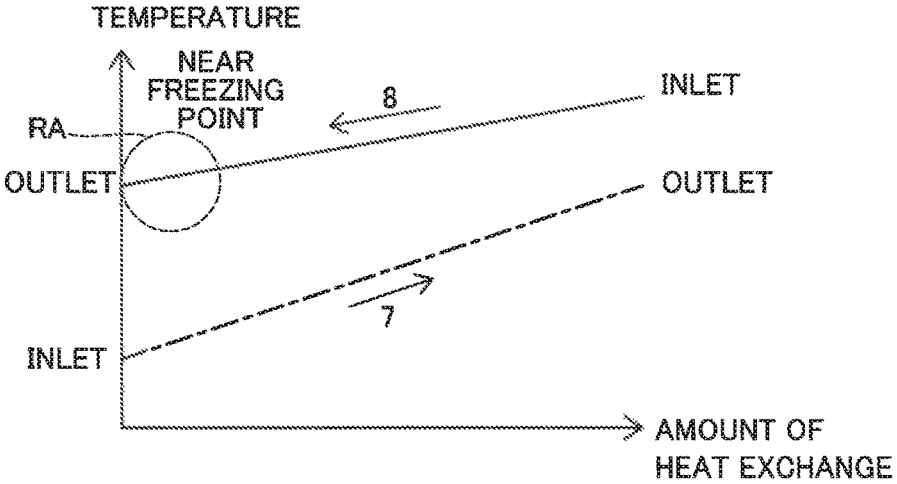
FIG. 16 (MODIFIED EXAMPLE: NO PHASE CHANGE, HIGH-TEMPERATURE FIRST FLUID)
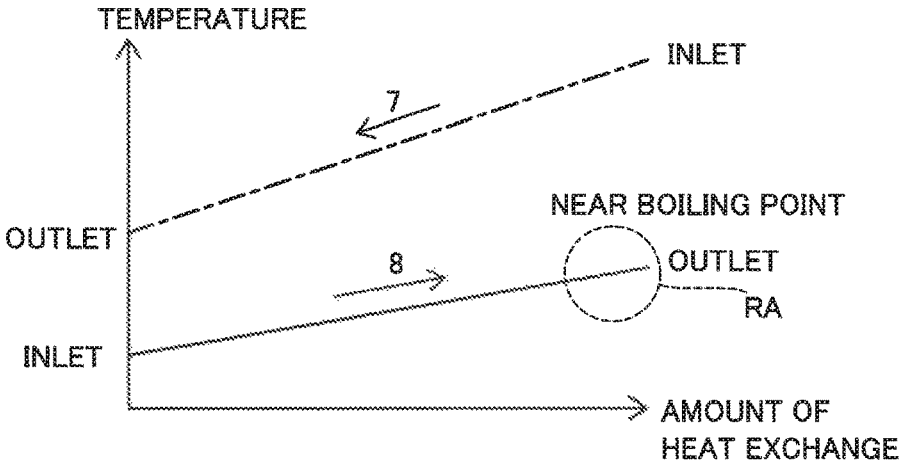

HEAT EXCHANGER

TECHNICAL FIELD

The present invention relates to a heat exchanger, and more particularly, it relates to a heat exchanger that performs heat exchange between a first fluid and a second fluid.

BACKGROUND ART

Conventionally, a heat exchanger that performs heat exchange between a first fluid and a second fluid is known. Such a heat exchanger is disclosed in Japanese Patent Laid-Open No. 2010-101617, for example.

Japanese Patent Laid-Open No. 2010-101617 discloses a plate-fin heat exchanger including a layer through which no fluid flows between heat exchange passage packages in which first passages through which a first fluid flows and second passages through which a second fluid flows are alternately disposed. In the heat exchange between the first fluid and the second fluid, the thermal stress increases as the temperature gradient increases. Therefore, in Japanese Patent Laid-Open No. 2010-101617, the layer through which no fluid flows is disposed between the heat exchange passage packages such that the temperature gradient is significantly reduced, and the thermal stress is reduced. The heat exchanger disclosed in Japanese Patent Laid-Open No. 2010-101617 is particularly used for applications such as liquefaction or vaporization of a natural gas having a large temperature difference with a fluid.

PRIOR ART

Patent Document

Patent Document 1: Japanese Patent Laid-Open No. 2010-101617

SUMMARY OF THE INVENTION

Problems to be Solved by the Invention

When the low-temperature first fluid is a cryogenic liquefied gas and the high-temperature second fluid is water or antifreeze, for example, there is a possibility that the passages are clogged by solidifying (freezing).

In the heat exchanger disclosed in Japanese Patent Laid-Open No. 2010-101617, although it is possible to reduce the thermal stress by providing the layer through which no fluid flows and significantly reducing or preventing excessive heat transfer between the flow paths, no consideration is given to the risk of occurrence of freezing in the flow paths, and there is a problem that the flow paths may be clogged by occurrence of freezing. In addition, simply providing the layer through which no fluid flows between the flow paths reduces the heat exchange performance, and thus there is a problem that the size of the heat exchanger is increased due to an increase in flow path length, for example.

The present invention has been proposed in order to solve the aforementioned problems, and one object of the present invention is to provide a heat exchanger in which an increase in its size can be significantly reduced or prevented while fluid freezing is significantly reduced or prevented even when heat exchange is performed between fluids having a large temperature difference.

Means for Solving the Problems

In order to attain the aforementioned object, a heat exchanger according to the present invention includes a first flow path through which a first fluid flows, a second flow path through which a second fluid flows, and an adjustment layer disposed between the first flow path and the second flow path adjacent to each other and that adjusts an amount of heat exchange between the first flow path and the second flow path, and the adjustment layer includes a first portion and a second portion having a heat transfer performance lower than that of the first portion, and has a heat transfer performance varied depending on a position in the adjustment layer.

As described above, the heat exchanger according to the present invention includes the adjustment layer disposed between the first flow path and the second flow path adjacent to each other and that adjusts the amount of heat exchange between the first flow path and the second flow path. Accordingly, the adjustment layer between the first flow path and the second flow path can significantly reduce or prevent excessive heat transfer between the first flow path and the second flow path. Consequently, fluid freezing can be significantly reduced or prevented even when heat exchange is performed between fluids having a large temperature difference. Furthermore, the adjustment layer includes the first portion and the second portion having a heat transfer performance lower than that of the first portion, and has a heat transfer performance varied depending on the position in the adjustment layer 30. Accordingly, the second portion is disposed in a portion in which freezing is likely to occur in the flow path to sufficiently decrease the heat transfer performance while the first portion is disposed in a portion in which freezing is unlikely to occur to relatively increase the heat transfer performance such that the high heat exchange performance can be ensured. Accordingly, an increase in a flow path length required to realize a desired amount of heat exchange can be significantly reduced or prevented. Thus, an increase in the size of the heat exchanger can be significantly reduced or prevented while fluid freezing is significantly reduced or prevented even when heat exchange is performed between fluids having a large temperature difference.

According to the present invention including the aforementioned configuration, even when there is a possibility of fluid boiling due to heat exchange, the fluid boiling can be significantly reduced or prevented. Occurrence of unintentional boiling in the flow path may increase the load related to the strength of the heat exchanger, and may not be acceptable due to the specification of the heat exchanger. According to the present invention, the second portion is disposed in a portion in which boiling is likely to occur in the flow path such that the heat transfer performance can be sufficiently decreased while the first portion is disposed in a portion in which boiling is unlikely to occur such that the heat transfer performance can be relatively increased. Accordingly, an increase in a flow path length required to realize a desired amount of heat exchange can be significantly reduced or prevented. Thus, an increase in the size of the heat exchanger can be significantly reduced or prevented while unintentional fluid boiling is significantly reduced or prevented.

In the aforementioned heat exchanger according to the present invention, in the adjustment layer, the second portion is preferably provided within a predetermined range including a portion that overlaps a vicinity of an inlet or a vicinity of an outlet of the second fluid. According to this configuration, when the temperature of the second fluid monotonously decreases along the second flow path, for example, the second portion includes the portion that overlaps the vicinity of the outlet of the second fluid, which is highly likely to freeze such that occurrence of freezing can be effectively and significantly reduced or prevented. When the temperature of the first fluid becomes cryogenic in the vicinity of the inlet of the second fluid in a parallel-flow heat exchanger and the inner surface temperature of the second flow path is close to the freezing temperature, for example, the second portion includes the portion that overlaps the vicinity of the inlet of the second fluid, which is highly likely to freeze such that occurrence of freezing can be effectively and significantly reduced or prevented.

In the aforementioned heat exchanger according to the present invention, the second flow path preferably includes a risk area in which an inner surface temperature of the second flow path is closest to a temperature of the first fluid, and in the adjustment layer, the second portion is preferably disposed within a predetermined range including a portion that overlaps the risk area of the second flow path. According to this configuration, the second portion overlaps the risk area such that occurrence of freezing can be more reliably and significantly reduced or prevented. The risk area can be set as an area in which the inner surface temperature of the second flow path obtained by calculating the temperature distribution of the inner surface of the second flow path when the adjustment layer is not provided (when the first flow path and the second flow path are directly adjacent to each other), for example, is closest to the temperature of the first fluid.

In the aforementioned heat exchanger according to the present invention, the adjustment layer preferably includes heat conduction portions that make a connection between the first flow path and the second flow path adjacent to each other, and the first portion and the second portion preferably include the heat conduction portions having different heat transfer performances. According to this configuration, the shape and dimensions of the adjustment layer itself are not adjusted, but the number, size, material, etc. of the heat conduction portions are changed such that the distribution of the heat transfer performances in the first portion and the second portion can be easily adjusted. Consequently, the appropriate distribution of the heat transfer performances according to the risk of occurrence of fluid freezing in the adjustment layer can be easily realized.

In this case, a density per unit area of the heat conduction portions in the adjustment layer is preferably varied such that the heat conduction portions have the different heat transfer performances. According to this configuration, unlike the case in which a plurality of types of heat conduction portions made of different materials are provided, for example, the number of heat conduction portions per unit area is changed or a plurality of heat conduction portions having different sizes are arranged at an equal pitch, for example, such that the heat transfer performances of the heat conduction portions can be easily varied.

In the aforementioned configuration in which the adjustment layer includes the heat conduction portions, each of the first flow path, the second flow path, and the adjustment layer preferably includes a planar flow path layer, and includes a heat transfer fin inside the planar flow path layer, the heat conduction portions are preferably constituted by the heat transfer fin disposed in the adjustment layer, and at least one of intervals between fin sections of the heat transfer fin and thicknesses of the fin sections are preferably different from each other such that the heat conduction portions have the different heat transfer performances. According to this configuration, the first flow path, the second flow path, and the adjustment layer can share a similar basic structure, and thus each of the first flow path, the second flow path, and the adjustment layer can be each of the flow path layers of the so-called plate-fin heat exchanger. Consequently, unlike the case in which a special structure is used for the adjustment layer, the heat exchanger can be easily constructed even when the adjustment layer is provided. In addition, the heat transfer performance of the adjustment layer can be varied by a simple configuration in which the intervals between the fin sections or the thicknesses of the fin sections are simply different from each other.

In the aforementioned heat exchanger according to the present invention, the adjustment layer preferably has a hollow flow path structure disposed between the first flow path and the second flow path and through which a fluid can flow except during the heat exchange. According to this configuration, the hollow structure can easily decrease the heat transfer performance of the adjustment layer, and thus occurrence of freezing can be effectively and significantly reduced or prevented. In addition, the adjustment layer has a hollow flow path structure through which a fluid can flow except during the heat exchange such that as a measure against occurrence of fluid freezing, a heat medium having a temperature higher than the freezing temperature can flow through the adjustment layer except during the heat exchange between the first fluid and the second fluid so as to quickly eliminate freezing.

In the aforementioned heat exchanger according to the present invention, the first fluid is preferably a low-temperature liquefied gas evaporated in the first flow path, and the second fluid is preferably a liquid heat medium cooled by the liquefied gas. In such a configuration, there is a possibility of freezing on the second fluid side by heat exchange between the cryogenic first fluid and the second fluid. Even in this case, the first portion and the second portion are provided to vary the heat transfer performance of the adjustment layer such that the heat transfer efficiency can be increased as much as possible within a range in which freezing of the second fluid can be significantly reduced or prevented, and thus an increase in the size of the heat exchanger can be effectively and significantly reduced or prevented.

In this case, in the adjustment layer, the first portion is preferably disposed within a range that overlaps a vapor phase region of the first fluid that flows through the first flow path, and in the adjustment layer, the second portion is preferably disposed within a range that overlaps a vapor-liquid mixed phase region of the first fluid that flows through the first flow path. According to this configuration, in the vapor-liquid mixed phase region in which the heat transfer coefficient of the first fluid is high, freezing of the second fluid is significantly reduced or prevented by the second portion having a low heat transfer performance, and in the vapor phase region in which the heat transfer coefficient of the first fluid is low, heat exchange can be efficiently performed by the first portion having a high heat transfer performance. Consequently, the heat exchanger can be made as compact as possible while freezing of the second fluid is significantly reduced or prevented.

In the aforementioned structure in which the adjustment layer has a hollow flow path structure through which a fluid can flow except during the heat exchange, when freezing of the second fluid occurs in the second flow path, a heat medium is preferably supplied to the adjustment layer except during the heat exchange so as to eliminate the freezing of the second fluid. According to this configuration, even when freezing occurs in the second flow path, the heat medium for eliminating freezing is supplied to the adjustment layer after the heat exchange (supply of the first fluid and the second fluid) is stopped such that freezing can be easily and quickly eliminated.

Effect of the Invention

According to the present invention, as described above, the heat exchanger in which an increase in its size can be significantly reduced or prevented while fluid freezing is significantly reduced or prevented even when heat exchange is performed between fluids having a large temperature difference can be provided.

BRIEF DESCRIPTION OF THE DRAWINGS

FIG. 14 A schematic view showing a configuration example of an adjustment layer in a cross-flow heat exchanger.

FIG. 15 A diagram showing a first example (low-temperature first fluid) when the first fluid does not undergo a phase change.

FIG. 16 A diagram showing a second example (high-temperature first fluid) when the first fluid does not undergo a phase change.

MODES FOR CARRYING OUT THE INVENTION

An embodiment of the present invention is hereinafter described on the basis of the drawings.

The configuration of a heat exchanger 100 according to the present embodiment is now described with reference to FIGS. 1 to 6.

Overall Configuration of Heat Exchanger

Figure 1:
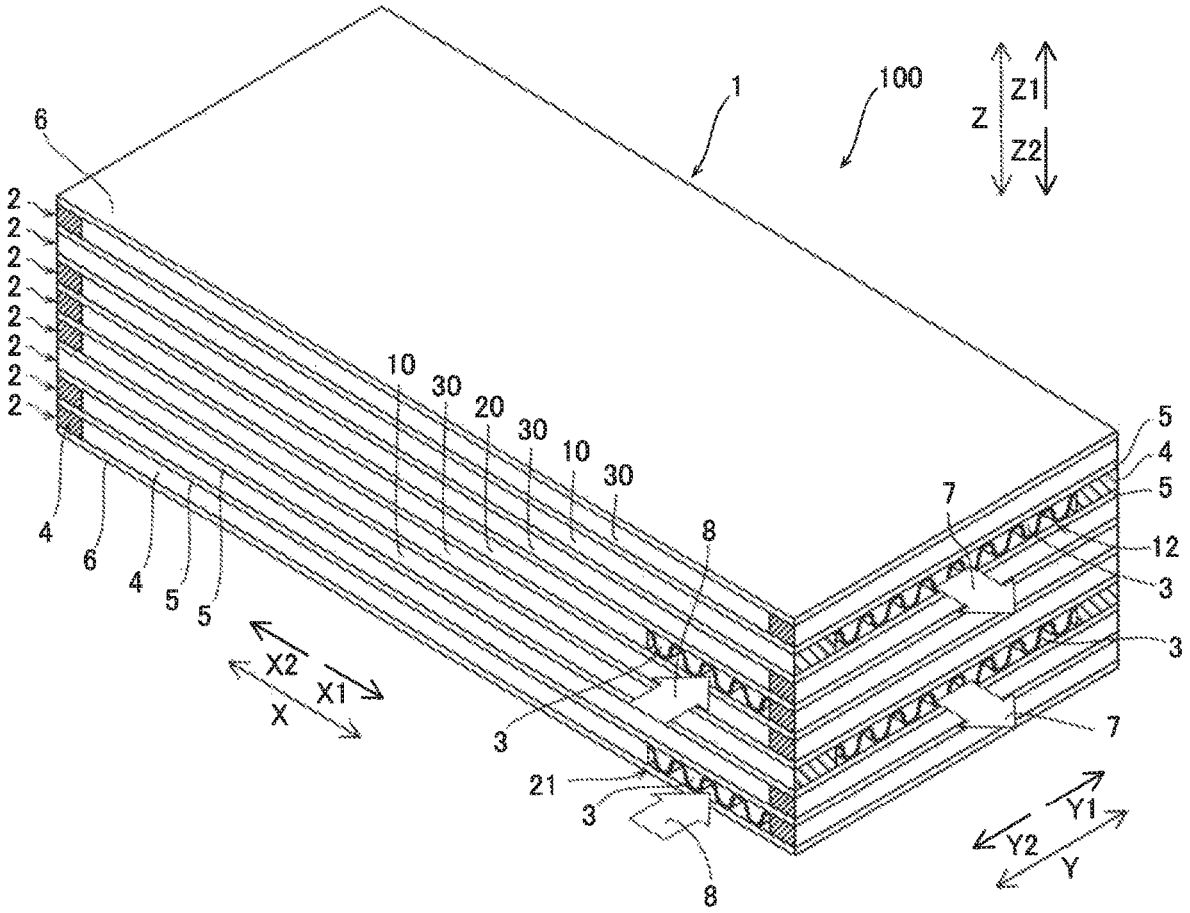
FIG. 1 A perspective view showing a heat exchanger according to the present embodiment.

The heat exchanger 100 shown in FIG. 1 is an apparatus (heat exchanger) that performs heat exchange between a low-temperature liquefied gas and a heat medium to cool the heat medium utilizing the cold heat of the liquefied gas.

The liquefied gas is hydrogen, oxygen, nitrogen or a natural gas, for example. The heat medium used for a liquefied gas evaporator is varied, but from the viewpoint of availability (low cost) etc., a liquid such as water, seawater, or antifreeze, air, or the like is used. These liquids and air (moisture in the air) have the property of freezing at a temperature higher than the supply temperature of the liquefied gas.

In the first embodiment, the heat exchanger 100 includes a plate-fin core 1. The plate-fin core 1 is a heat exchanging portion having a stacked structure in which a plurality of planar flow path layers 2 are stacked. In the following description, for convenience, the stacking direction of the flow path layers 2 is defined as a Z direction (or an upward-downward direction), a longitudinal direction along one side of the core 1 in a horizontal plane orthogonal to the Z direction is defined as an X direction, and a short-side direction along another side of the core 1 in the horizontal plane orthogonal to the Z direction is defined as a Y direction.

The flow path layers 2 of the core 1 each have a planar (flat plate) structure including a heat transfer fin 3 and side bars 4 that constitute the outer peripheral wall of the heat transfer fin 3. In addition, each flow path layer 2 is divided by tube plates 5, which are partition walls on the stacking direction side. The heat transfer fin 3 is a corrugated fin having a corrugated shape, and contacts the upper and lower tube plates 5 at the peak portions of the corrugated portions. The corrugated heat transfer fin 3 divides the inside of the flow path layer 2 to create a plurality of flow paths (channels). The tube plates 5 and the heat transfer fin 3 function as heat transfer surfaces that transmit heat in the core 1. In the core 1, a stacked body of the stacked flow path layers 2 is sandwiched by a pair of side plates 6 and is bonded by brazing or the like such that the core 1 has a rectangular box shape (rectangular parallelepiped shape) as a whole. The core 1 is made of a material such as stainless steel, for example.

The core 1 includes first flow paths 10 through which a first fluid 7 flows and second flow paths 20 through which a second fluid 8 flows. In the present embodiment, the first fluid 7 is a low-temperature fluid, and the second fluid 8 is a high-temperature fluid. That is, the first fluid 7 is a low-temperature liquefied gas evaporated in the first flow paths 10, and the second fluid 8 is a liquid heat medium cooled by the liquefied gas. It is assumed that the first fluid 7 and the second fluid 8 are fluids, one of which may be frozen by heat exchange with the other. In the present embodiment, among the first fluid 7 and the second fluid 8, the second fluid 8 is a fluid having a risk of occurrence of freezing in the flow path. As an example in the present embodiment, the liquefied gas is liquid hydrogen, for example, and the heat medium is antifreeze, for example. The antifreeze is a liquid that mainly contains water and a freezing point depressant (such as ethylene glycol). The first fluid 7 is an example of a "liquefied gas" in the claims. The second fluid 8 is an example of a "heat medium" in the claims.

In the present embodiment, the core 1 further includes an adjustment layer 30 disposed between the first flow path 10 and the second flow path 20 adjacent to each other and that adjusts the amount of heat exchange between the first flow path 10 and the second flow path 20. The adjustment layer 30 is disposed between all the first flow paths 10 and the second flow paths 20. That is, in the core 1, the flow path layers are stacked in the order of the first flow path 10, the adjustment layer 30, the second flow path 20, the adjustment layer 30, . . . . Therefore, in the present embodiment, the first flow path 10 and the second flow path 20 are not directly adjacent to each other (with the tube plate 5 interposed therebetween).

Figure 2:
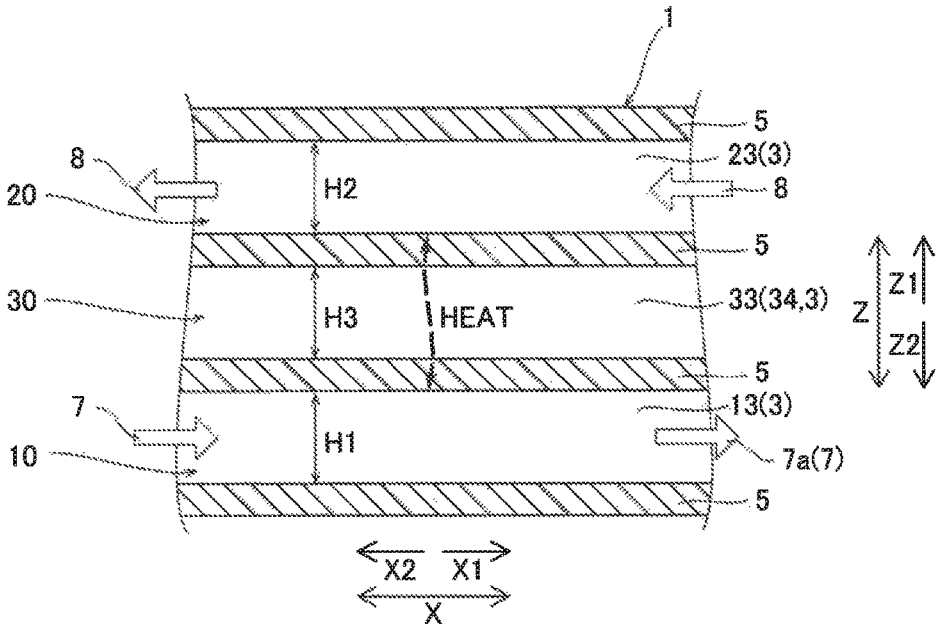
FIG. 2 A schematic longitudinal section view of the heat exchanger showing a first flow path, a second flow path, and an adjustment layer.

As shown in FIG. 2, in the core 1, heat exchange is performed between the low-temperature first fluid 7 that flows through the first flow path 10 and the high-temperature second fluid 8 that flows through the second flow path 20 via the adjustment layer 30. In the first embodiment, the core 1 cools the second fluid 8 (antifreeze) that flows through the second flow path 20 by heat exchange with the first fluid 7 (liquid hydrogen) that flows through the first flow path 10. As a result of the heat exchange, the heat exchanger 100 cools the liquid second fluid 8 to a predetermined temperature and supplies (discharges) the same, which remains in a liquid phase, to the outside. As a result of the heat exchange, the heat exchanger 100 evaporates the first fluid 7 in the liquid phase to convert the same into a gas 7*a* in a vapor state, and supplies (discharges) the gas 7*a* to the outside.

Structure of Flow Path Layer

The structure of each of the flow path layers 2 (the first flow path 10, the second flow path 20, and the adjustment layer 30) is now described with reference to FIGS. 3 to 5. A plurality of first flow paths 10 have the same shape, a plurality of second flow paths 20 have the same shape, and a plurality of adjustment layers 30 have the same shape. As can be seen from FIG. 1, in the first flow paths 10, the second flow paths 20, and the adjustment layers 30 (the respective flow path layers 2), only the positions of inlets and outlets of the fluids are different, and the first flow paths 10, the second flow paths 20, and the adjustment layers 30 have substantially the same planar shape (a shape in the X and Y directions). All of the first flow paths 10, the second flow paths 20, and the adjustment layers 30 have a width W1 and a length L1 (see FIGS. 3 to 5). On the other hand, as shown in FIG. 2, the height H1 of the first flow path 10, the height H2 of the second flow path 20, and the height H3 of the adjustment layer 30 may be equal to each other or may be different from each other. As described above, each of the first flow path 10, the second flow path 20, and the adjustment layer 30 includes the planar flow path layer 2, and includes the heat transfer fin 3 (a heat transfer fin 13, 23, or 34 described below) inside the planar flow path layer 2.

<First Flow Path>

Figure 3:
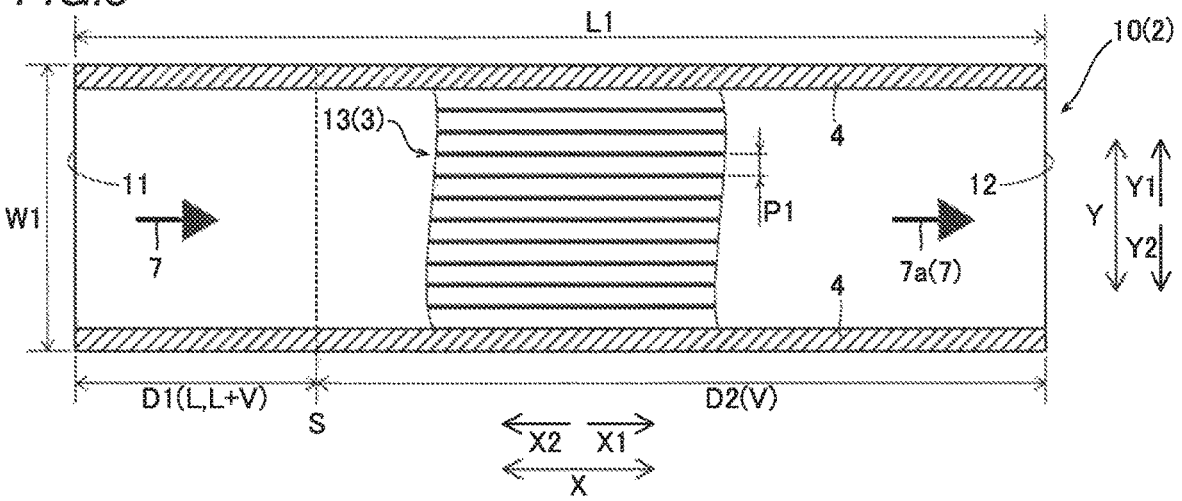
FIG. 3 A schematic horizontal sectional view showing the structure of the first flow path.

As shown in FIG. 3, the first flow path 10 includes an inlet (opening) 11 provided in an X2-side end face and an outlet (opening) 12 provided in an X1-side end face, and is a linear flow path that extends in the X direction. In a configuration example shown in FIG. 3, the first fluid 7 flows in an X1 direction from the inlet 11 toward the outlet 12.

The heat transfer fin 3 provided in the first flow path 10 is hereinafter referred to as the heat transfer fin 13. The heat transfer fin 13 of the first flow path 10 extends from the inlet 11 to the outlet 12 of the first flow path 10. In FIG. 3, the heat transfer fin 13 is illustrated only in a central portion of the first flow path 10 for convenience, and illustration of the heat transfer fin 13 in the remaining portions is omitted. The heat transfer fin 13 has a predetermined pitch P1 over the entire first flow path 10. The pitch is an interval between longitudinal plates (see FIG. 6) of the heat transfer fin 13 (heat transfer fin 3).

Header tanks or the like (not shown) are attached to the inlet 11 and the outlet 12, respectively. The first fluid 7 in the liquid phase is supplied from the outside to the inlet 11 via the header tank, and the first fluid 7 (gas 7*a*) after heat exchange (after vaporization) is discharged from the outlet 12 via the header tank. Therefore, the first flow path 10 includes a liquid phase region (L), a vapor-liquid mixed phase region (L+V), and a vapor phase region (V) from the inlet 11 side toward the outlet 12 side based on phase changes in the first fluid 7 that flows through the first flow path 10.

<Second Flow Path>

Figure 4:
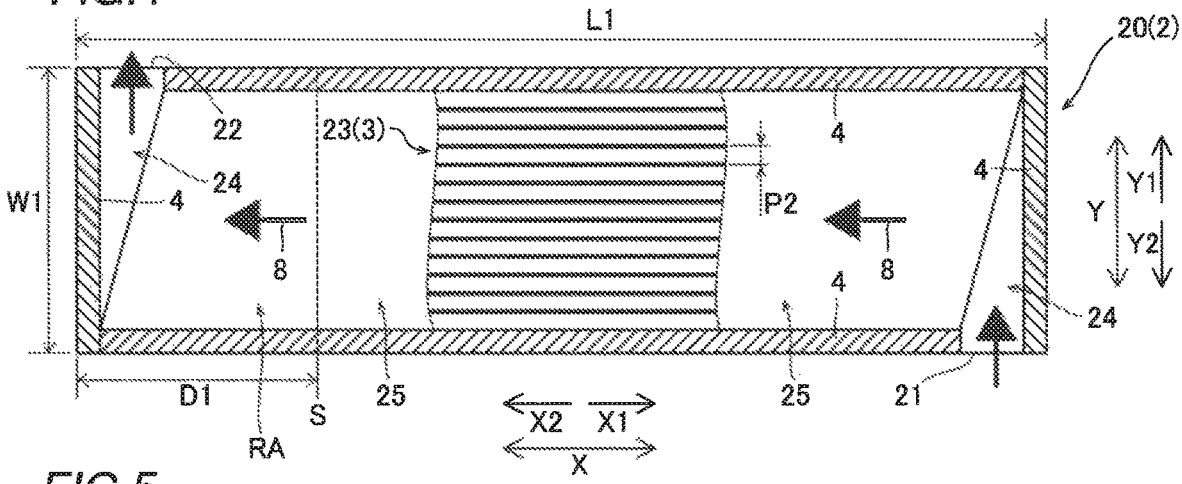
FIG. 4 A schematic horizontal sectional view showing the structure of the second flow path.

As shown in FIG. 4, the second flow path 20 includes an inlet (opening) 21 provided at an X1-side end of a Y2-side end face and an outlet (opening) 22 provided at an X2-side end of a Y1-side end face, and is a linear flow path that extends in the X direction. In a configuration example shown in FIG. 4, the second fluid 8 flows in an X2 direction from the inlet 21 toward the outlet 22. Therefore, the heat exchanger 100 according to the present embodiment is a counter-flow heat exchanger in which the flowing direction (X1 direction) of the first fluid 7 and the flowing direction (X2 direction) of the second fluid 8 are opposite to each other.

The heat transfer fin 3 provided in the second flow path 20 is hereinafter referred to as the heat transfer fin 23. The heat transfer fin 23 of the second flow path 20 extends from the inlet 21 to the outlet 22 of the second flow path 20. In FIG. 4, the heat transfer fin 23 is illustrated only in a central portion of the second flow path 20 for convenience, and illustration of the heat transfer fin 23 in the remaining portions is omitted. The heat transfer fin 23 has a predetermined pitch P2 over the entire linear portion 25 excluding distributors 24 provided at the inlet 21 and the outlet 22. In the present embodiment, the pitch P2 is smaller than the pitch P1. That is, the number of longitudinal plates per unit width is larger in the heat transfer fin 23 than in the heat transfer fin 13, and the density of the longitudinal plates per unit area is higher in the heat transfer fin 23 than in the heat transfer fin 13. In each of the distributors 24, the second fluid 8 is distributed (or aggregated) between the linear portion 25 and the inlet 21 or the outlet 22, and thus the pitch is different from that in the linear portion 25. The distributors 24 and the linear portion 25 may have the same pitch.

Header tanks or the like (not shown) are attached to the inlet 21 and the outlet 22, respectively. The second fluid 8 is supplied from the outside to the inlet 21 via the header tank, and the second fluid 8 after heat exchange is discharged from the outlet 22 via the header tank.

<Adjustment Layer>

Figure 5:
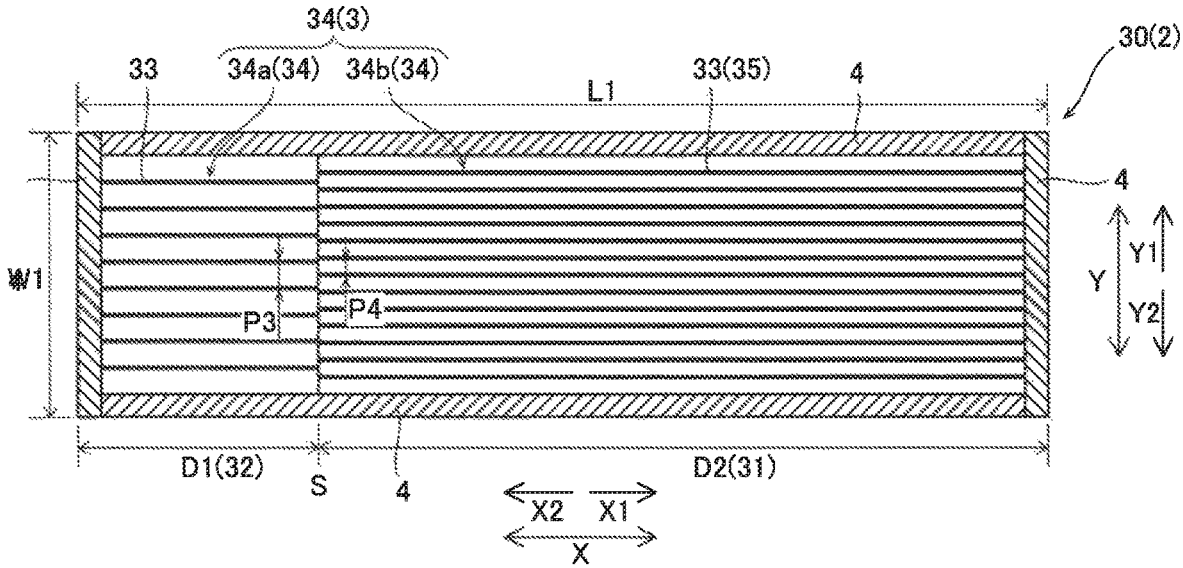
FIG. 5 A schematic horizontal sectional view showing the structure of the adjustment layer.

As shown in FIG. 5, the adjustment layer 30 according to the present embodiment is a flow path layer 2 having a shape that matches with those of the first flow path 10 and the second flow path 20 in a plan view. On the other hand, the adjustment layer 30 according to the present embodiment is a layer through which no fluid flows. That is, the adjustment layer 30 in FIG. 5 is surrounded by the side bars 4 on the entire circumference, and no inlet or outlet is provided. The adjustment layer 30 has a hollow structure. Although in FIG.

5, the inside of the adjustment layer 30 is illustrated as if it is completely closed, the adjustment layer 30 may be hermetically sealed in a vacuum state (low pressure state) or in a state filled with a predetermined gas, or may partially communicate with the outside such that the inside and outside of the adjustment layer 30 are in the same atmosphere. As shown in FIG. 2, the adjustment layer 30 is provided such that as compared with the case in which the first flow path 10 and the second flow path 20 are simply divided by the tube plate 5, the performance of heat transfer between the first flow path 10 and the second flow path 10 decreases. That is, the adjustment layer 30 has an adjustment function so as to reduce the amount of heat exchange (as compared with the case in which the first flow path 10 and the second flow path 20 are directly adjacent to each other) between the first flow path 10 and the second flow path 20.

Returning to FIG. 5, in the present embodiment, the adjustment layer 30 includes a first portion 31 and a second portion 32 having a heat transfer performance lower than that of the first portion 31, and has a heat transfer performance varied depending on a position in the adjustment layer 30. That is, the adjustment layer 30 includes a portion (first portion 31) having a high heat transfer performance and a portion (second portion 32) having a low heat transfer performance in a plane parallel to the first flow path 10 and the second flow path 20, and the adjustment layer 30 has a distribution of high and low heat transfer performances.

In this specification, the heat transfer performance of the adjustment layer 30 indicates the ease of heat transmission when heat is transmitted between the first flow path 10 and the second flow path 20 via the adjustment layer 30. The heat transfer performance can be considered as total performance including heat transmission due to each of heat conduction, heat transfer (convection heat transfer), and heat radiation.

In a configuration example shown in FIG. 5, the adjustment layer 30 includes one first portion 31 and one second portion 32. In the adjustment layer 30, the second portion 32 is provided within a predetermined range including a portion that overlaps the vicinity of the inlet 21 or the vicinity of the outlet 22 of the second flow path 20. In the present embodiment, the second portion 32 is provided in a portion adjacent to (overlapping) a region in the vicinity of the outlet 22 of the second flow path 20. The first portion 31 is provided in a region of the adjustment layer 30 other than the predetermined range in which the second portion 32 is provided. Consequently, in the adjustment layer 30, the heat transfer performance on the downstream side of the second flow path 20 is lower than the heat transfer performance on the upstream side of the second flow path 20.

In the present embodiment, in the adjustment layer 30, the second portion 32 is disposed within the predetermined range including a portion that overlaps a risk area RA of the second flow path 20. The risk area RA is an area of the second flow path 20 in which the inner surface temperature is closest to the temperature of the first fluid 7. The inner surface temperature of the second flow path 20 is the surface temperatures of the tube plates 5 that define the second flow path 20. The inner surface temperature of the second flow path 20 is influenced by the temperature of the low-temperature first fluid 7 and the heat transfer performance on the first flow path 10 side, and thus the positions and ranges of the first portion 31 and the second portion 32 are set by the relationship between the first fluid 7 that flows through the first flow path 10 and the second fluid 8 that flows through the second flow path 20.

Specifically, referring to FIGS. 3 and 5, in the adjustment layer 30, the first portion 31 is disposed within a range that overlaps the vapor phase region (V) of the first fluid 7 that flows through the first flow path 10, and in the adjustment layer 30, the second portion 32 is disposed within a range that overlaps the vapor-liquid mixed phase region (L+V) of the first fluid 7 that flows through the first flow path 10. Furthermore, in the present embodiment, the second portion 32 is also provided in a range that overlaps the liquid phase region (L) in addition to the vapor-liquid mixed phase region (L+V).

The heat transfer performance in the first flow path 10 varies with phase changes in the liquefied gas that flows through the first flow path 10. The vapor-liquid mixed phase region (L+V) is a region in which the heat transfer coefficient of the first fluid 7 becomes the highest and the inner surface temperature of the second flow path 20 becomes closest to the temperature of the first fluid 7 with heat exchange. That is, the risk area RA in which the risk of occurrence of freezing of the second fluid 8 in the second flow path 20 is the highest is an area that overlaps the vapor-liquid mixed phase region (L+V) of the first flow path 10. Furthermore, in the second flow path 20, a region that overlaps the liquid phase region (L) of the first flow path 10 is on the downstream side (outlet 22 side) of the risk area RA, and thus in the region, the risk of occurrence of freezing is the second highest next to that in the vapor-liquid mixed phase region (L+V). On the other hand, the vapor phase region (V) is a region in which the temperature of the first fluid 7 increases in the first flow path 10, and in the region, the heat transfer coefficient of the first fluid 7 is the lowest. In addition, as compared with the remaining regions, the inner surface temperature of the second flow path 20 is not decreased. Therefore, a region that overlaps the vapor phase region (V) is a region in which the first portion 31 with a low risk of occurrence of freezing and a high heat transfer performance can be placed.

The liquid phase region (L), the vapor-liquid mixed phase region (L+V), and the vapor phase region (V) in the first flow path 10 can be analytically determined based on the type of fluid, the flow rate, the inlet temperature and outlet temperature, the working pressure, and design information about the structure of each flow path, for example.

In the configuration examples shown in FIGS. 3 to 5, the liquid phase region (L) and the vapor-liquid mixed phase region (L+V) are ranges up to a distance D1 (position S) from the inlet 11 of the first flow path 10. Therefore, the second portion 32 of the adjustment layer 30 is set in the range of the distance D1 from the X2-side end. The vapor phase region (V) is a range of a distance D2 from a position S to the downstream side (outlet 12 side) in the first flow path 10. The first portion 31 of the adjustment layer 30 is set in the range of the distance D2 on the downstream side from the position S.

In the present embodiment, the adjustment layer 30 includes heat conduction portions 33 that make a connection between the first flow path 10 and the second flow path 20 adjacent to each other. The heat conduction portions 33 contact the tube plate 5 (see FIG. 2) that divides the adjustment layer 30 from the first flow path 10, contact the tube plate 5 that divides the adjustment layer 30 from the second flow path 20, and transmit heat mainly by internal heat conduction.

The adjustment layer 30 has a hollow structure through which no fluid flows, and thus most of heat transmission is due to heat conduction through the heat conduction portions 33 while heat transmission due to heat transfer (convection heat transfer) and heat radiation is slight as compared with heat conduction. Therefore, in the adjustment layer 30, it is possible to vary the heat transfer performance depending on the structure, arrangement, and number of the heat conduction portions 33.

Figure 6:
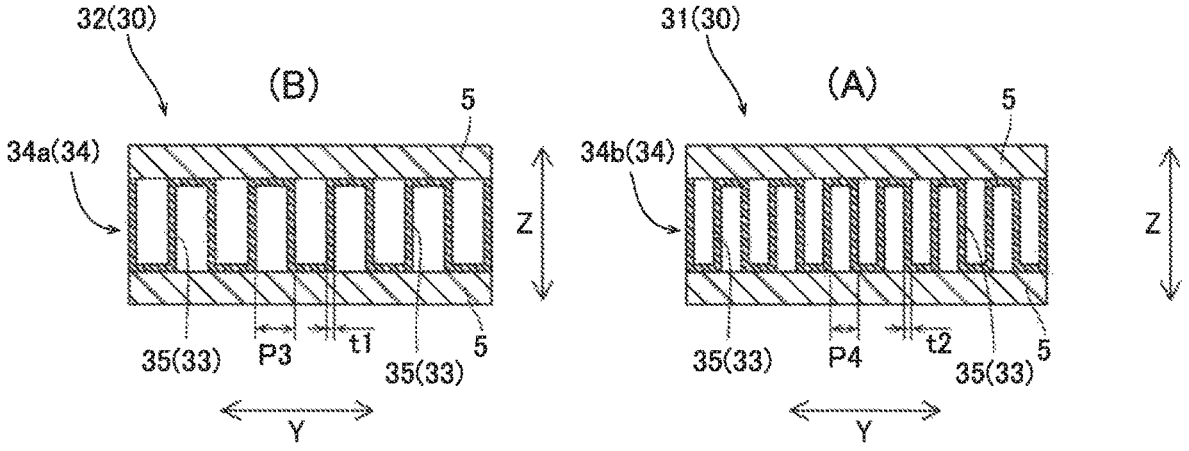
FIG. 6 A schematic sectional view (A) showing the structure of a first portion of the adjustment layer and a schematic sectional view (B) showing the structure of a second portion of the adjustment layer.

The heat conduction portions 33 are not particularly restricted as long as the same each have a structure that makes a connection between the first flow path 10 and the second flow path 20 (between the tube plates 5). The heat conduction portions 33 may be columnar or block-shaped members, or may be plate-shaped or lattice-shaped members, for example. In the present embodiment, the heat conduction portions 33 are constituted by the heat transfer fin 34 (heat transfer fin 3) disposed in the adjustment layer 30. The heat transfer fin 34 is a corrugated fin similar to the heat transfer fins 13 and 23 of the other flow path layers 2. In this case, as shown in FIG. 6, the heat conduction portions 33 are constituted by the longitudinal plates 35 of the heat transfer fin 34, which make a connection between the tube plates 5. Therefore, as shown in FIG. 5, the heat conduction portions 33 extend along the flowing direction (X direction) of the first fluid 7 and are disposed at an interval with a predetermined pitch.

In the present embodiment, the first portion 31 and the second portion 32 include the heat conduction portions 33 having different heat transfer performances. Specifically, the density per unit area of the heat conduction portions 33 in the adjustment layer 30 is varied such that the heat conduction portions 33 have different heat transfer performances. In the present embodiment in which the heat conduction portions 33 are constituted by the heat transfer fin 34, intervals between the longitudinal plates 35 of the heat transfer fin 34 are different from each other such that the heat conduction portions 33 have different heat transfer performances. That is, the pitches of the heat conduction portions 33 (the longitudinal plates 35 of the heat transfer fin 34) are different between the first portion 31 and the second portion 32. The longitudinal plates 35 are examples of a "fin section" in the claims.

That is, as shown in FIG. 6(B), a heat transfer fin 34*a* having a pitch P3 is provided in the second portion 32 of the adjustment layer 30, and as shown in FIG. 6(A), a heat transfer fin 34*b* having a pitch P4 is provided in the first portion 31 of the adjustment layer 30. The pitch P3 is larger than the pitch P4 (P3>P4). In other words, the number of heat conduction portions 33 (the longitudinal plates 35 of the heat transfer fin) in the unit width is smaller in the second portion 32 than in the first portion 31. Therefore, the density of the heat conduction portions 33 per unit area becomes relatively sparse (low density) in the second portion 32 along the flowing direction (X direction) of the first fluid 7, and becomes relatively dense (high density) in the first portion 31. The pitch P3 and the pitch P4 are examples of an "interval between the fin sections" in the claims.

For example, a configuration example in FIGS. 6(A) and 6(B) shows that the heat transfer fin 34*a* having a pitch P3 includes ten longitudinal plates 35 (heat conduction portions 33) per unit width (1 inch), and the heat transfer fin 34*b* having a pitch P4 includes fourteen longitudinal plates 35 (heat conduction portions 33) per unit width.

The thickness of each of the longitudinal plates 35 may be different between the first portion 31 and the second portion 32. That is, the thickness t1 in the heat transfer fin 34*a* of the second portion 32 and the thickness t2 in the heat transfer fin 34*b* of the first portion 31 may be different from each other such that the heat conduction portions 33 may have different heat transfer performances. Both the pitch and the thickness of the longitudinal plates 35 may be different between the first portion 31 and the second portion 32. In this case, the density of the longitudinal plates 35 per unit area may be relatively low in the second portion 32 and may be relatively high in the first portion 31.

With such a configuration, the heat transfer performance of the second portion 32 of the adjustment layer 30 is relatively low. Consequently, the second portion 32 significantly reduces or prevents freezing of the second fluid 8 of the second flow path 20 even when the cryogenic first fluid 7 flows in through the inlet 11 of the first flow path 10.

On the other hand, the heat transfer performance of the first portion 31 of the adjustment layer 30 is relatively high. Consequently, the first portion 31 promotes heat exchange between the first flow path 10 and the second flow path 20 as compared with the second portion 32.

Effects of Present Embodiment

According to the present embodiment, the following effects are achieved.

According to the present embodiment, as described above, the adjustment layer 30 disposed between the first flow path 10 and the second flow path 20 adjacent to each other and that adjusts the amount of heat exchange between the first flow path 10 and the second flow path 20 is provided. Accordingly, the adjustment layer 30 between the first flow path 10 and the second flow path 20 can significantly reduce or prevent excessive heat transfer between the first flow path 10 and the second flow path 20. Consequently, fluid freezing can be significantly reduced or prevented even when heat exchange is performed between fluids having a large temperature difference. Furthermore, the adjustment layer 30 includes the first portion 31 and the second portion 32 having a heat transfer performance lower than that of the first portion 31, and has a heat transfer performance varied depending on the position in the adjustment layer 30. Accordingly, the second portion 32 is disposed in a portion in which freezing is likely to occur in the flow path to sufficiently decrease the heat transfer performance while the first portion 31 is disposed in a portion in which freezing is unlikely to occur to relatively increase the heat transfer performance such that the high heat exchange performance can be ensured. Accordingly, an increase in a flow path length required to realize a desired amount of heat exchange can be significantly reduced or prevented. Thus, an increase in the size of the heat exchanger 100 can be significantly reduced or prevented while fluid freezing is significantly reduced or prevented even when heat exchange is performed between fluids having a large temperature difference.

According to the present embodiment, as described above, in the adjustment layer 30, the second portion 32 is provided within the predetermined range (the range of the distance D1) including the portion that overlaps the vicinity of the inlet 21 or the vicinity of the outlet 22 of the second fluid 8. Accordingly, when the temperature of the second fluid 8 monotonously decreases along the second flow path 20, for example, the second portion 32 includes the portion that overlaps the vicinity of the outlet 22 of the second fluid 8, which is highly likely to freeze such that occurrence of freezing can be effectively and significantly reduced or prevented.

According to the present embodiment, as described above, in the adjustment layer 30, the second portion 32 is disposed within the predetermined range (the range of the distance D1) including the portion that overlaps the risk area RA (the area in which the inner surface temperature of the second flow path 20 is closest to the temperature of the first fluid 7) of the second flow path 20. Accordingly, the second portion 32 overlaps the risk area RA such that occurrence of freezing can be more reliably and significantly reduced or prevented.

According to the present embodiment, as described above, the adjustment layer 30 includes the heat conduction portions 33 that make a connection between the first flow path 10 and the second flow path 20 adjacent to each other, and the first portion 31 and the second portion 32 include the heat conduction portions 33 having different heat transfer performances. Accordingly, the shape and dimensions of the adjustment layer 30 itself are not adjusted, but the number, size, material, etc. of the heat conduction portions 33 are changed such that the distribution of the heat transfer performances in the first portion 31 and the second portion 32 can be easily adjusted. Consequently, the appropriate distribution of the heat transfer performances according to the risk of occurrence of fluid freezing in the adjustment layer 30 can be easily realized.

According to the present embodiment, as described above, the density per unit area of the heat conduction portions 33 (the pitch of the longitudinal plates 35) in the adjustment layer 30 is varied such that the heat conduction portions 33 have different heat transfer performances. Accordingly, the heat transfer performances of the heat conduction portions 33 can be easily varied depending on their positions in the flowing direction, unlike the case in which a plurality of types of heat conduction portions 33 made of different materials are provided, for example.

According to the present embodiment, as described above, the first flow path 10, the second flow path 20, and the adjustment layer 30 each include the planar flow path layer 2. Furthermore, the heat conduction portions 33 are constituted by the heat transfer fin 34 (heat transfer fin 3) disposed in the adjustment layer 30, and at least one of the pitches (P3, P4) between the longitudinal plates 35 of the heat transfer fin 34 (34*a*, 34*b*) and the thicknesses (t1, t2) of the longitudinal plates 35 are different from each other such that the heat conduction portions 33 have different heat transfer performances. Accordingly, the first flow path 10, the second flow path 20, and the adjustment layer 30 can share a similar basic structure, and thus each of the first flow path 10, the second flow path 20, and the adjustment layer 30 can be each of the flow path layers 2 of the plate-fin heat exchanger 100. Consequently, unlike the case in which a special structure is used for the adjustment layer 30, the heat exchanger 100 can be easily constructed even when the adjustment layer 30 is provided. In addition, the heat transfer performance of the adjustment layer 30 can be varied by a simple configuration in which the pitches between the longitudinal plates 35 or the thicknesses of the longitudinal plates 35 are simply different from each other.

According to the present embodiment, as described above, the first fluid 7 is a low-temperature liquefied gas evaporated in the first flow path 10, and the second fluid 8 is a liquid heat medium cooled by the liquefied gas. In such a configuration, there is a possibility of freezing on the second fluid 8 side by heat exchange between the cryogenic first fluid 7 and the second fluid 8. Even in this case, the first portion 31 and the second portion 32 are provided to vary the heat transfer performance of the adjustment layer 30 such that the heat transfer efficiency can be increased as much as possible within a range in which freezing of the second fluid 8 can be significantly reduced or prevented, and thus an increase in the size of the heat exchanger 100 can be effectively and significantly reduced or prevented.

According to the present embodiment, as described above, in the adjustment layer 30, the first portion 31 is disposed within the range that overlaps the vapor phase region (V) of the first fluid 7 that flows through the first flow path 10, and in the adjustment layer 30, the second portion 32 is disposed within the range that overlaps the vapor-liquid mixed phase region (L+V) of the first fluid 7 that flows through the first flow path 10. Accordingly, in the vapor-liquid mixed phase region (L+V) in which the heat transfer coefficient of the first fluid 7 is high, freezing of the second fluid 8 is significantly reduced or prevented by the second portion 32 having a low heat transfer performance, and in the vapor phase region (V) in which the heat transfer coefficient of the first fluid 7 is low, heat exchange can be efficiently performed by the first portion 31 having a high heat transfer performance. Consequently, the heat exchanger 100 can be made as compact as possible while freezing of the second fluid 8 is significantly reduced or prevented.

Description of Simulation Results

The effects of the heat exchanger 100 according to the present embodiment are now described using simulation results with reference to FIGS. 7 to 10. In the simulation, temperature changes in the first fluid 7 and the second fluid 8 during passing through the heat exchanger were calculated, and the flow path lengths required for the fluids to reach predetermined target temperatures (required to obtain a predetermined amount of heat exchange) were obtained.

The simulation was performed on Comparative Example 1 in which the adjustment layer 30 was not provided (in which the first flow path 10 and the second flow path 20 are divided by the tube plate 5), Comparative Example 2 in which only the low-density heat transfer fin 34*a* was provided over the entire adjustment layer 30 (in which the heat transfer performance of the entire adjustment layer 30 corresponded to the heat transfer performance of the second portion 32), and Comparative example 3 in which only the high-density heat transfer fin 34*b* was provided over the entire adjustment layer 30 (in which the heat transfer performance of the entire adjustment layer 30 corresponded to the heat transfer performance of the first portion 31) in addition to the heat exchanger 100 according to the present embodiment described above.

In the simulation, hydrogen (liquid hydrogen) was used as the first fluid 7, antifreeze was used as the second fluid 8, and a calculation was performed with the same conditions such as the flow rate and the pressure. As the simulation conditions, the inlet temperature of the liquid hydrogen was −253° C., the boiling point thereof was −242.5° C., and the outlet temperature thereof was −50° C. The freezing point of the antifreeze was −50° C., the inlet temperature thereof was −39° C., and the outlet temperature (target temperature) thereof after cooling with hydrogen was −43° C. In the simulation, the average of the surface temperature (the surface temperature on the second flow path 20 side; see FIG. 2) of the tube plate 5 between the second flow path 20 and the adjustment layer 30 was calculated. When the surface temperature reaches −50° C., it is believed that freezing of the second fluid 8 occurs in the second flow path 20.

Figure 7:
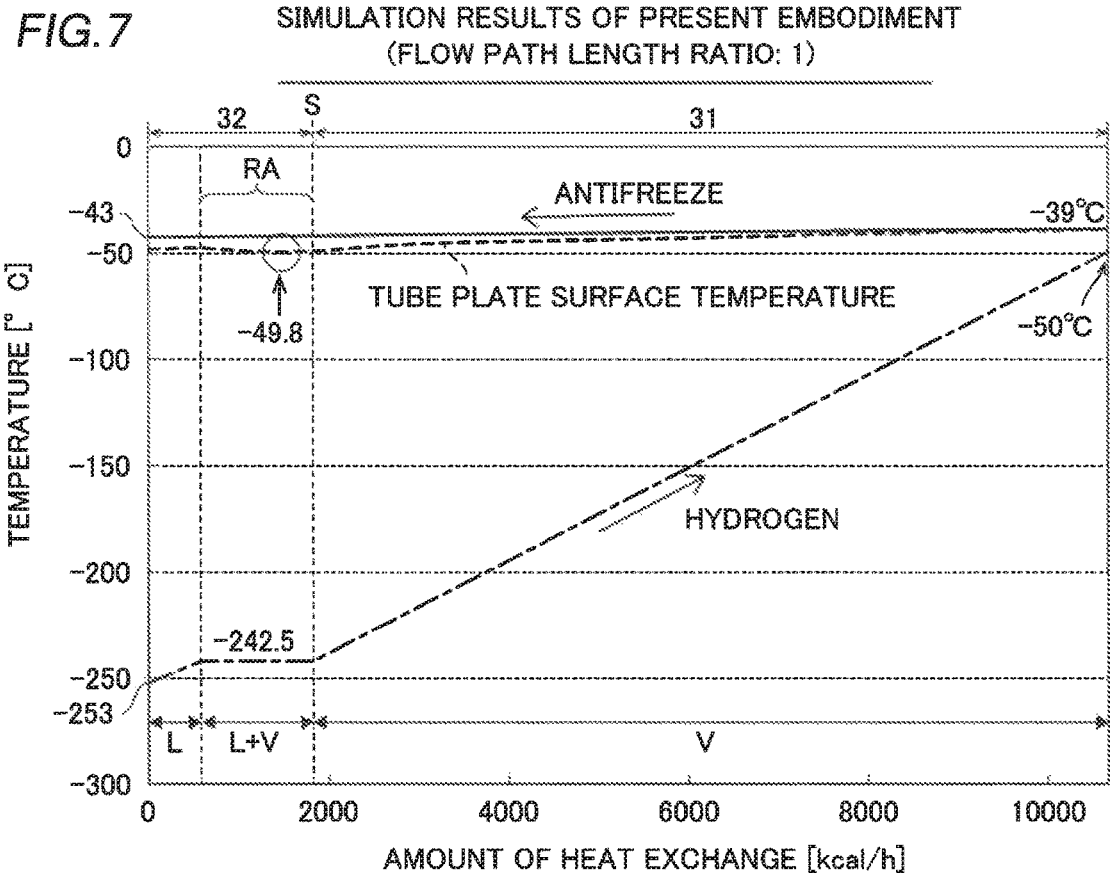
FIG. 7 A diagram showing simulation results of changes in the temperatures of fluids in the heat exchanger according to the present embodiment.
Figure 8:
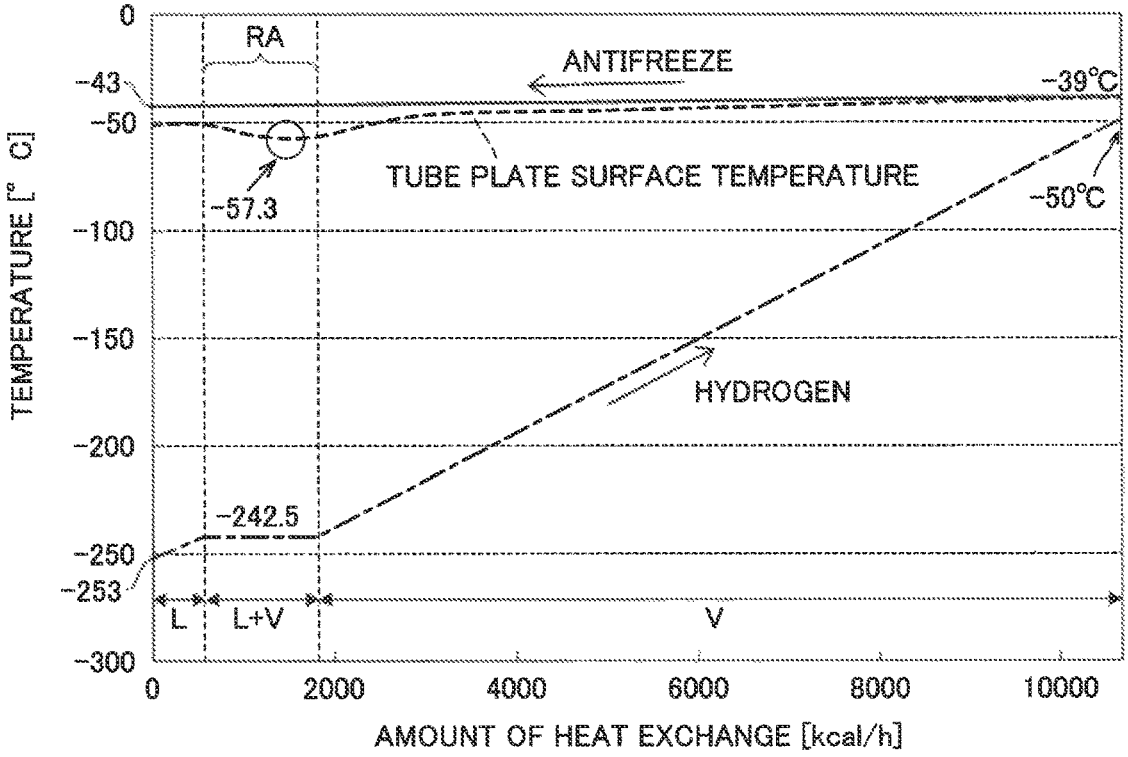
FIG. 8 A diagram showing simulation results of changes in the temperature of the fluids in a heat exchanger according to Comparative Example 1.
Figure 9:
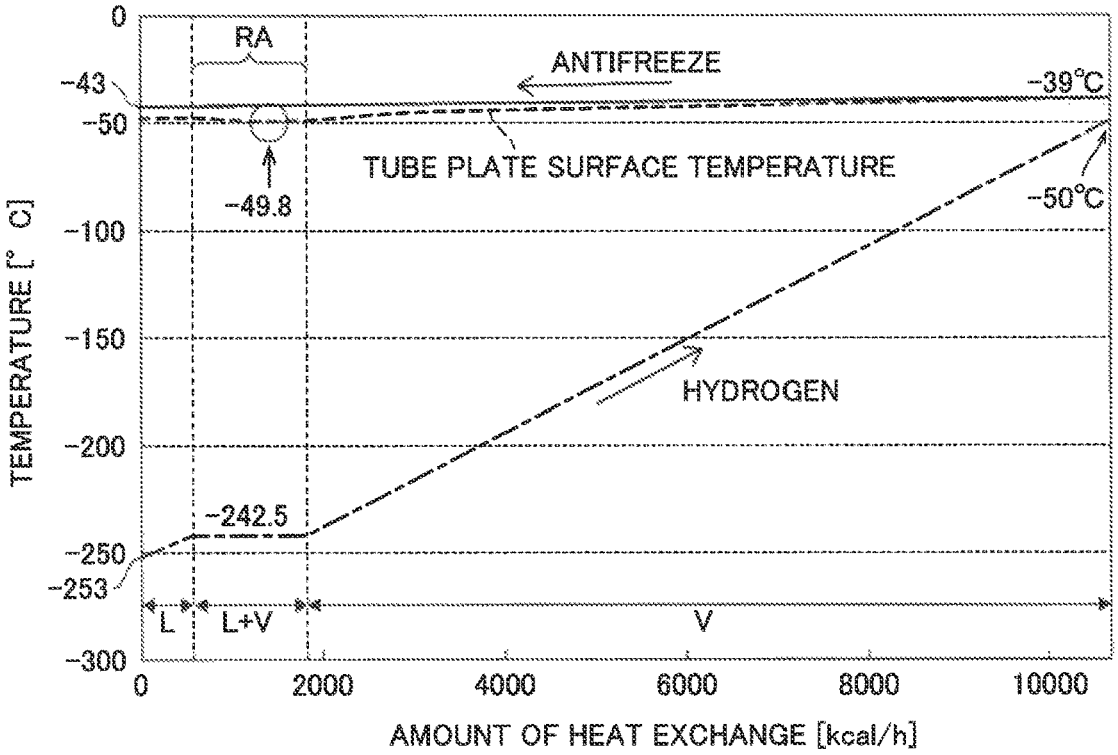
FIG. 9 A diagram showing simulation results of changes in the temperature of the fluids in a heat exchanger according to Comparative Example 2.
Figure 10:
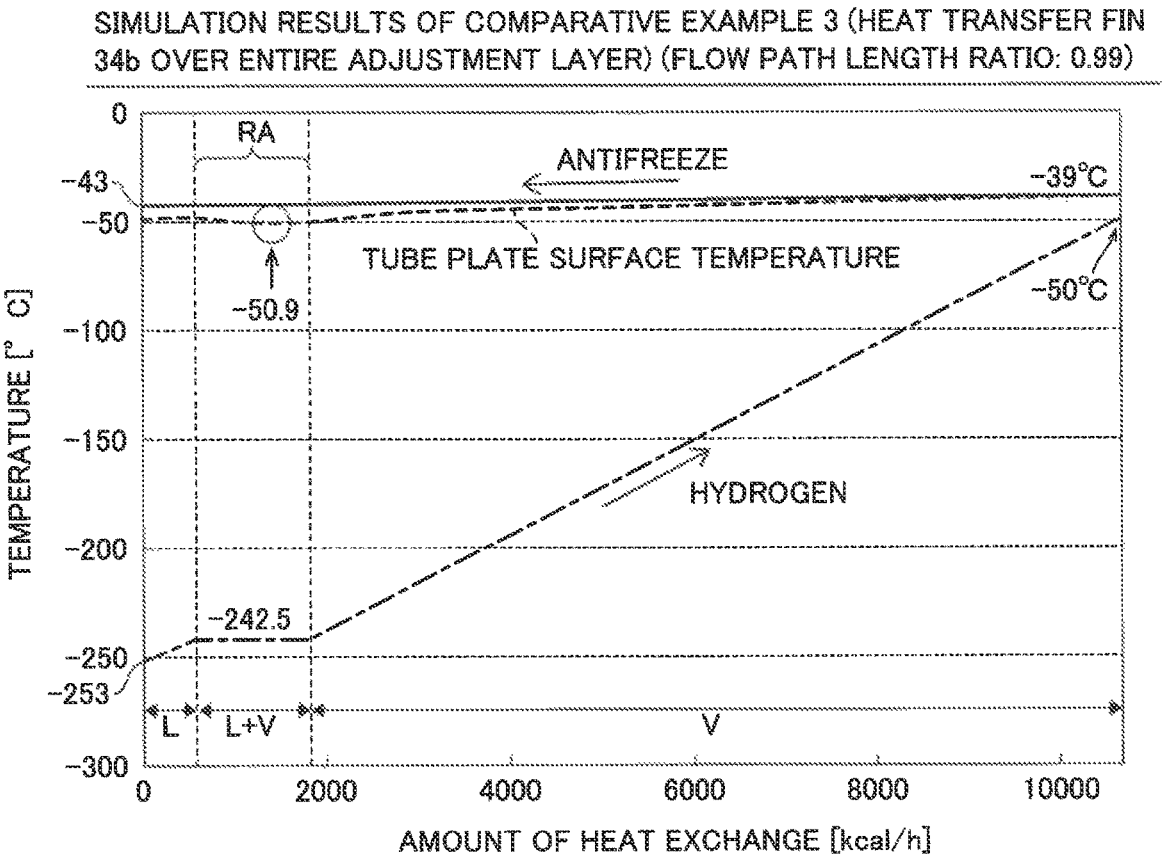
FIG. 10 A diagram showing simulation results of changes in the temperature of the fluids in a heat exchanger according to Comparative Example 3.

FIG. 7 shows the simulation results of the heat exchanger 100 according to the present embodiment, FIG. 8 shows the simulation results of Comparative Example 1, FIG. 9 shows the simulation results of Comparative Example 2, and FIG. 10 shows the simulation results of Comparative Example 3. In FIGS. 7 to 10, the vertical axis represents the temperature [° C.], and the horizontal axis represents the amount of heat exchange [kcal/h]. In all the simulation results, the total amounts of heat exchange are the same, but the flow path lengths required to reach the outlet temperatures are different. In the simulation, the flow path lengths of First Comparative Example to Third Comparative Example were calculated from a value of the ratio with the flow path length of the heat exchanger 100 according to the present embodiment taken as 1 (reference).

<Risk of Occurrence of Freezing>

As a common trend in FIGS. 7 to 10, the liquid hydrogen flows into the inlet in the liquid phase and then becomes a vapor-liquid mixed phase at the boiling point (−242.5° C.), and after the temperature constant state continues until an amount corresponding to the latent heat, the temperature increases again in a vapor state. The surface temperature of the tube plate 5 became the lowest when the hydrogen was in a vapor-liquid mixed phase state. In other words, the risk of occurrence of freezing of the antifreeze (second fluid 8) is maximized in a portion of the second flow path 20 that overlaps the vapor-liquid mixed phase region (L+V).

In the heat exchanger 100 (see FIG. 7) according to the present embodiment, the surface temperature of the tube plate 5 (the inner surface temperature of the second flow path 20) became the lowest in the vapor-liquid mixed phase region (L+V), which was −49.8° C. In Comparative Example 1 (see FIG. 8), the lowest surface temperature of the tube plate 5 was −57.3° C. In Comparative Example 2 (see FIG. 9), the lowest surface temperature of the tube plate 5 was −49.8° C. In Comparative Example 3 (see FIG. 10), the lowest surface temperature of the tube plate 5 was −50.9° C.

In the heat exchanger 100 according to the present embodiment and Comparative Example 2, it has been found that the surface temperature is −50° C. or higher, and thus freezing of the antifreeze hardly occurs. On the other hand, in Comparative Example 1 and Comparative Example 3, it has been found that the surface temperature is lower than −50° C., and thus freezing of the antifreeze occurs.

<Flow Path Length>

When the flow path length of the heat exchanger 100 according to the present embodiment was 1, the flow path length was 0.38 in Comparative Example 1, 1.18 in Comparative Example 2, and 0.99 in Comparative Example 3. That is, the flow path length required to move the same amount of heat is in the order of Comparative Example 1<Comparative Example 3<the present embodiment<Comparative Example 2.

The simulation results together indicate that although the heat transfer performance is high and the flow path length can be reduced in Comparative Example 1 in which the adjustment layer 30 is not provided and Comparative Example 3 in which only the high-density heat transfer fin 34*b* is provided in the adjustment layer 30, freezing occurs in the second flow path 20, and thus there is a risk of clogging the flow path. On the other hand, the simulation results together indicate that although freezing in the second flow path 20 can be prevented in Comparative Example 2 in which only the low-density heat transfer fin 34*b* is provided in the adjustment layer 30, the flow path length is 1.18 times that in the present embodiment, and the size of the heat exchanger is increased.

On the other hand, the simulation results together indicate that in the heat exchanger 100 according to the present embodiment, freezing in the second flow path 20 can be prevented similarly to Comparative Example 3, and the temperature of the liquid hydrogen can be increased to the target temperature with the same flow path length as that in Comparative Example 2. Therefore, in the heat exchanger 100 according to the present embodiment, it has been confirmed that an increase in its size can be significantly reduced or prevented while fluid freezing is significantly reduced or prevented.

In the heat exchanger 100, the risk area RA and the position and range of the second portion 32 in the adjustment layer 30 can be set based on the temperature distribution in Comparative Example 1 (in which the adjustment layer 30 is not provided) shown in FIG. 8. That is, first, the structures of the first flow path 10 and the second flow path 20 are determined, and the temperature distribution in the case in which the adjustment layer 30 is not provided as in Comparative Example 1 is obtained. From the calculation results, it has been found that in an example shown in FIG. 8, the risk area RA exists in the vapor-liquid mixed phase region (L+V). Therefore, in the adjustment layer 30, the second portion 32 is disposed in the risk region RA (vapor-liquid mixed phase region (L+V)) and the liquid phase region (L) on the downstream side to insure a margin of safety, and the first portion 31 having a high heat transfer performance is disposed in a region other than the second portion 32 such that the position and range of the second portion 32 can be set.

[Modified Examples]

The embodiment disclosed this time must be considered as illustrative in all points and not restrictive. The scope of the present invention is not shown by the above description of the embodiment but by the scope of claims for patent, and all modifications (modified examples) within the meaning and scope equivalent to the scope of claims for patent are further included.

For example, while the example in which the low-temperature liquefied gas is used as the first fluid 7 and the liquid heat medium for vaporizing the liquefied gas is used as the second fluid 8 has been shown in the aforementioned embodiment, the present invention is not restricted to this. According to the present invention, the first fluid 7 may be a high-temperature gas such as exhaust gas after combustion or after reaction, and the second fluid 8 may be a liquid refrigerant (such as water) for cooling the high-temperature gas. That is, the first flow path 10 may be a flow path on the high-temperature side, and the second flow path 20 may be a flow path on the low-temperature side. In this case, boiling of the second fluid 8 may occur in the second flow path 20 due to heat exchange. The occurrence of unintentional boiling in the flow path may increase the load related to the strength of the heat exchanger, and may not be acceptable due to the specification of the heat exchanger. In the present invention, even when there is a possibility of fluid boiling, boiling of the second fluid 8 in the second flow path 20 can be significantly reduced or prevented by the adjustment layer 30. Furthermore, the adjustment layer 30 includes the first portion 31 and the second portion 32 having different heat transfer performances such that the high heat exchange performance can be ensured, and thus an increase in the size of the heat exchanger can be significantly reduced or prevented.

While the example in which the plate-fin heat exchanger 100 is provided has been shown in the aforementioned embodiment, the present invention is not restricted to this. According to the present invention, a heat exchanger other than the plate-fin heat exchanger may be used.

Figure 11:
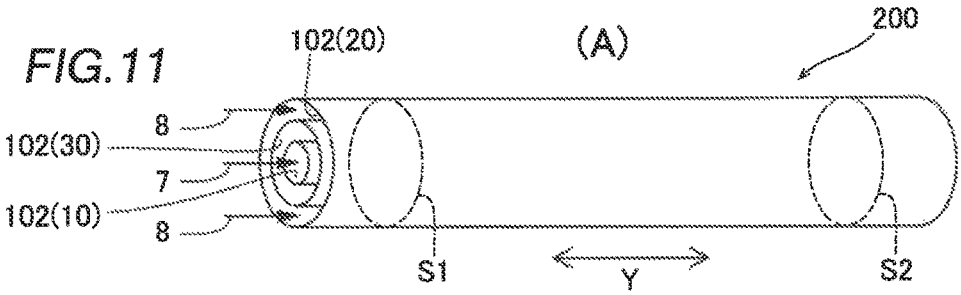
FIG. 11 A schematic view (A) showing a modified example of the heat exchanger according to the present embodiment, a sectional view (B) on the upstream side of the heat exchanger according to the modified example, and a sectional view (C) on the downstream side of the heat exchanger according to the modified example.
Figure 11:
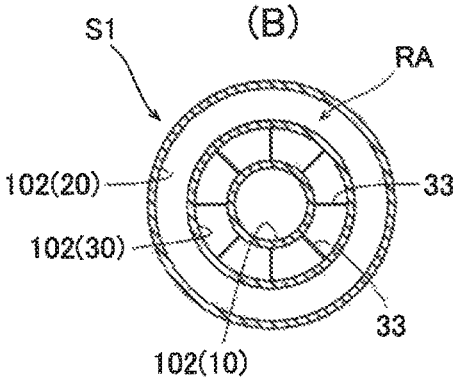
Figure 11:
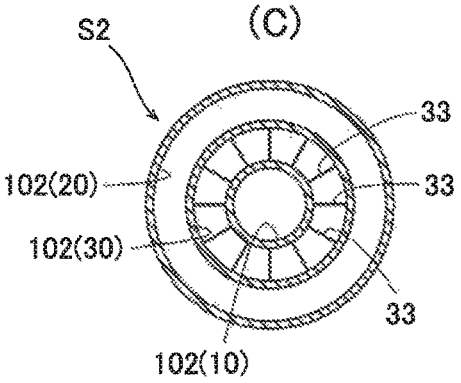

For example, the present invention may be applied to a multi-tube heat exchanger 200 as in a modified example shown in FIGS. 11(A) to 11(C). In the heat exchanger 200, three cylindrical flow path layers 102 are concentrically disposed. For example, a first flow path 10 includes an innermost flow path layer 102, and a second flow path 20 includes an outermost flow path layer 102. An adjustment layer 30 includes an intermediate flow path layer 102 between the first flow path 10 and the second flow path. In this modified example, the heat transfer performance of the adjustment layer 30 is different at a position S1 on the upstream side and a position S2 on the downstream side, for example, in the flowing direction (X direction) of a first fluid 7 as in the aforementioned embodiment. Specifically, as shown in FIG. 11(B) showing the cross-section at the position S1 and FIG. 11(C) showing the cross-section at the position S2, heat conduction portions 33 are disposed in the adjustment layer 30, and the density (number) of the heat conduction portions 33 may be varied.

Besides this, the heat exchanger according to the present invention may be a plate heat exchanger in which corrugated metal plates including flow paths integrally formed on the front and back sides are stacked and bonded by seal, welding, or the like such that flow path layers are formed between the metal plates. Alternatively, the heat exchanger may be a diffusion-bonded heat exchanger in which metal plates including flow paths formed by grooving are stacked and integrated by diffusion-bonding, for example, such that flow path layers are provided between the metal plates.

While the example in which the flow path layers are alternately stacked one by one in the order of the first flow path 10, the adjustment layer 30, the second flow path 20, the adjustment layer 30, . . . has been shown in the aforementioned embodiment, the present invention is not restricted to this. According to the present invention, a plurality of same flow path layers may be successively stacked. That is, a plurality of first flow path layers 10 may be successively stacked in such a manner that the first flow path 10, the first flow path 10, the adjustment layer 30, the second flow path 20, the adjustment layer 30, the first flow path 10, the first flow path 10, . . . are stacked. Alternatively, a plurality of adjustment layers 30 may be successively stacked in such a manner that the first flow path 10, the adjustment layer 30, the adjustment layer 30, the second flow path 20, the adjustment layer 30, the adjustment layer 30, . . . are stacked.

Figure 12:
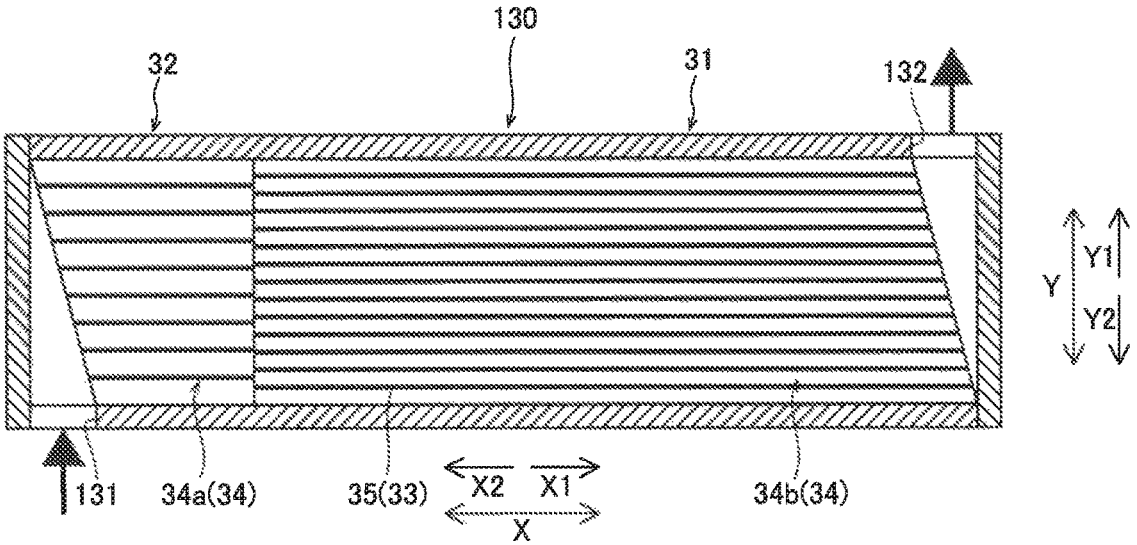
FIG. 12 A schematic horizontal sectional view showing a modified example of the adjustment layer according to the present embodiment.

While the example in which the adjustment layer 30 is a layer through which no fluid flows has been shown in the aforementioned embodiment, the present invention is not restricted to this. For example, as shown in a modified example of FIG. 12, an adjustment layer 130 through which a fluid can flow may be provided. The adjustment layer 130 in FIG. 12 has a hollow flow path structure disposed between a first flow path 10 and a second flow path 20 and through which a fluid can flow except during heat exchange. Specifically, the adjustment layer 130 includes an inlet (opening) 131 provided at an X2-side end of a Y2-side end face and an outlet (opening) 132 provided at an X1-side end of a Y1-side end face, and is formed as a linear flow path that extends in an X direction. A fluid is supplied from the outside to the inlet 131 via a header tank (not shown), and is discharged from the outlet 132 via a header tank. In this case, at the time of heat exchange between a first fluid 7 and a second fluid 8, no fluid flows through the adjustment layer 130 but the adjustment layer 130 is filled with air such that the similar effects to those of the adjustment layer 30 according to the aforementioned embodiment can be obtained.

When the adjustment layer 130 having a hollow flow path structure through which a fluid can flow except during heat exchange is provided as described above, the hollow structure can easily decrease the heat transfer performance of the adjustment layer 130, and thus occurrence of freezing and boiling can be effectively and significantly reduced or prevented. In addition, as a measure against occurrence of fluid freezing, a heat medium having a temperature higher than the freezing temperature can flow through the adjustment layer 130 except during heat exchange between the first fluid 7 and the second fluid 8 so as to quickly eliminate freezing.

That is, when freezing of the second fluid 8 occurs in the second flow path 20, a heat medium is supplied to the adjustment layer 130 except during heat exchange so as to eliminate the freezing of the second fluid 8. Accordingly, even when freezing occurs locally in the second flow path 20 after heat exchange, the heat medium for eliminating freezing is supplied to the adjustment layer 130 after the heat exchange (supply of the first fluid 7 and the second fluid 8) is stopped such that freezing can be easily and quickly eliminated.

Figure 13:
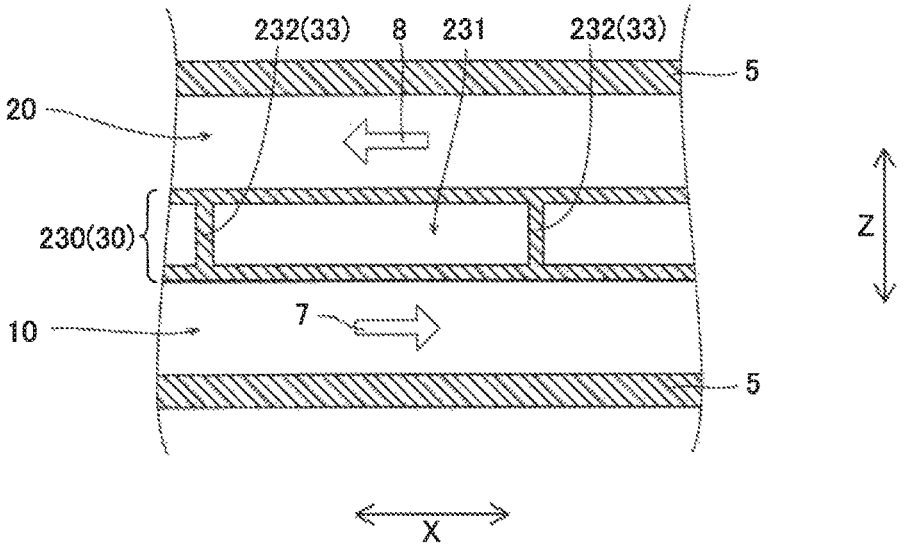
FIG. 13 A schematic longitudinal sectional view of the heat exchanger illustrating the modified example of the adjustment layer.

While the example in which the adjustment layer 30 includes the same flow path layer 2 as those of the first flow path 10 and the second flow path 20 has been shown in the aforementioned embodiment, the present invention is not restricted to this. According to the present invention, the adjustment layer need not include the flow path layer, and may have a layer structure other than the flow path layer. For example, as in a modified example shown in FIG. 13, a plate member 230 including a heat insulator 231 may be provided as the adjustment layer 30. The plate member 230 is a tube plate that divides a first flow path 10 and a second flow path 20 from each other. The heat transfer performance of the plate member 230 is decreased by the hollow heat insulator 231 provided therein, and the amount of heat exchange between the first flow path 10 and the second flow path 20 is adjusted. For example, a plurality of heat insulators 231 are provided in the plate member 230 and are divided by partition walls 232. Heat conduction portions 33 that make a connection between the first flow path 10 and the second flow path 20 adjacent to each other are constituted by the partition walls 232. In this modified example, the density of the partition walls 232 (i.e. the density of the heat insulators 231) is varied such that the heat transfer performance of the first portion 31 and the heat transfer performance of the second portion 32 can be different from each other.

While the counter-flow heat exchanger 100 in which the flowing direction of the first fluid 7 and the flowing direction of the second fluid 8 are opposite to each other has been shown as an example in the aforementioned embodiment, the present invention is not restricted to this. According to the present invention, the heat exchanger may be a parallel-flow heat exchanger other than the counter-flow heat exchanger. In the case of the parallel-flow heat exchanger, the inlet 11 of the first flow path 10 and the inlet 11 of the second flow path 20 are disposed on the same side. Therefore, when the risk of freezing the second fluid 8 is high, the temperature of the second fluid 8 can be increased in a region near the inlet at which the temperature of the first fluid 7 is the lowest, and thus the risk of freezing can be further significantly reduced or prevented. On the other hand, when the temperature difference between the first fluid 7 and the second fluid 8 is large near the outlet of the first flow path 10, the counter-flow heat exchanger is preferable because the heat exchange efficiency is increased and the size thereof can be reduced. Alternatively, the heat exchanger may be a cross-flow heat exchanger in which the flowing direction of the first fluid 7 and the flowing direction of the second fluid 8 are orthogonal to each other.

FIG. 14 shows a configuration example (an arrangement example of a first portion 31 and a second portion 32) of an adjustment layer 30 in a cross-flow heat exchanger 300. FIG.

14 shows an example in which a first fluid 7, which is a high-temperature fluid, flows in a Y1 direction through a first flow path (not shown), and a second fluid 8, which is a low-temperature fluid, flows in an X1 direction through a second flow path (not shown). In this case, the second fluid 8 has a risk of occurrence of boiling, and a risk area RA is a portion in the vicinity of an outlet of the second flow path 20 and in the vicinity of an inlet of the first flow path 10. Therefore, FIG. 14 shows an example in which the second portion 32 of the adjustment layer 30 is set in a triangular range that overlaps a corner in the vicinity of the outlet of the second flow path 20 and in the vicinity of the inlet of the first flow path 10, and the first portion 31 is set in the remaining region.

While the heat exchanger 100 including the plurality of first flow paths 10 and the plurality of second flow paths 20 has been shown as an example in the aforementioned embodiment, the present invention is not restricted to this. According to the present invention, the numbers of first flow paths and second flow paths are not particularly restricted. One first flow path and one second flow path may be provided, or two or more first flow paths and two or more second flow paths may be provided.

While the example in which the adjustment layer 30 is divided into two regions of the first portion 31 and the second portion 32, and the first portion 31 and the second portion 32 have different heat transfer performances has been shown in the aforementioned embodiment, the present invention is not restricted to this. According to the present invention, the adjustment layer 30 may include three or more portions having different heat transfer performances. For example, in the adjustment layer, three portions of a portion adjacent to the liquid phase region (L) of the liquefied gas, a portion adjacent to the vapor-liquid mixed phase region (L+V), and a portion adjacent to the vapor phase region (V) may have different heat transfer performances. Alternatively, in the adjustment layer 30, the heat transfer performance may continuously change, instead of including a plurality of regions having different heat transfer performances. For example, the density of the heat conduction portions 33 may be continuously increased from the upstream side to the downstream side in the flowing direction of the first fluid.

While the example in which the hollow adjustment layer 30 is provided has been shown in the aforementioned embodiment, the present invention is not restricted to this. According to the present invention, the inside of the adjustment layer 30 may be filled with a fluid or a solid such as a powder (particulate material) or a porous material. In this case, these fillers may function as heat conduction portions. The heat transfer performance can be varied by changing a material (thermal conductivity) of the filler, the particle diameter of the filler, the porosity of the filler, etc.

While the example in which the first fluid 7 in the first flow path 10 undergoes a phase change has been shown in the aforementioned embodiment, the present invention is not restricted to this. According to the present invention, as shown in FIG. 15, the low-temperature first fluid 7 may pass through the first flow path 10 in the liquid phase or the vapor phase without undergoing a phase change. When there is no phase change, the heat transfer performance on the first flow path 10 side may be considered to be substantially constant, and thus the risk area RA (the risk of occurrence of freezing) in the second flow path 20 is near the outlet of the second flow path 20. Furthermore, FIG. 16 shows an example in which the second fluid 8 is a low-temperature fluid, and the first fluid 7 is a high-temperature fluid. Also in this case, the risk area RA (the risk of occurrence of boiling) in the second flow path 20 is near the outlet of the second flow path 20. Therefore, in the cases of FIGS. 15 and 16, the second portion 32 of the adjustment layer 30 may be set to include a portion that overlaps the vicinity of the outlet of the second fluid 8 and to correspond to the risk area RA near the outlet of the second flow path 20.

DESCRIPTION OF REFERENCE NUMERALS 2, 102: flow path layer
7: first fluid (liquefied gas)
8: second fluid (heat medium)
10: first flow path
20: second flow path
30, 130: adjustment layer
31: first portion
32: second portion
33: heat conduction portion
(34*a*, 34*b*): heat transfer fin
35: longitudinal plate (fin section)
50: risk area
100, 200, 300: heat exchanger
P3, P4: pitch between the longitudinal plates (interval between the fin sections)
t1, t2: thickness of the longitudinal plate
X: flowing direction of the first fluid

The invention claimed is:

1. A heat exchanger comprising:
a first flow path through which a first fluid flows;
a second flow path through which a second fluid flows; and
an adjustment layer disposed between the first flow path and the second flow path adjacent to each other and that adjusts an amount of heat exchange between the first flow path and the second flow path; wherein
the first flow path, the second flow path, and the adjustment layer each include a planar flow path layer and are stacked on each other;
the adjustment layer includes a first portion and a second portion having a heat transfer performance lower than that of the first portion, and has a heat transfer performance varied depending on a position in the adjustment layer; and
the first portion and the second portion include heat conduction structures that make a connection between the first flow path and the second flow path adjacent to each other and having different heat transfer performances.

2. The heat exchanger according to claim 1, wherein in the adjustment layer, the second portion is provided within a predetermined range including a portion that overlaps a vicinity of an inlet or a vicinity of an outlet of the second fluid.

3. The heat exchanger according to claim 1, wherein
the second flow path includes a risk area in which an inner surface temperature of the second flow path is closest to a temperature of the first fluid; and
in the adjustment layer, the second portion is disposed within a predetermined range including a portion that overlaps the risk area of the second flow path.

4. The heat exchanger according to claim 1, wherein a density per unit area of the heat conduction structures in the adjustment layer is varied such that the heat conduction structures have the different heat transfer performances.

5. The heat exchanger according to claim 1, wherein
each of the first flow path, the second flow path, and the adjustment layer includes a heat transfer fin inside; and the heat conduction structures are constituted by the heat transfer fin disposed in the adjustment layer, and at least one of intervals between fin sections of the heat transfer fin and thicknesses of the fin sections are different from each other such that the heat conduction structures have the different heat transfer performances.

6. The heat exchanger according to claim 1, wherein the adjustment layer has a hollow flow path structure disposed between the first flow path and the second flow path and through which a fluid can flow except during the heat exchange.

* * * * *